US010079426B2

(12) United States Patent
Sonozaki et al.

(10) Patent No.: US 10,079,426 B2
(45) Date of Patent: Sep. 18, 2018

(54) CHIP ANTENNA

(71) Applicant: NTN CORPORATION, Osaka (JP)

(72) Inventors: Tomokazu Sonozaki, Mie (JP); Hiroyuki Noda, Mie (JP); Natsuhiko Mori, Mie (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 15/317,262

(22) PCT Filed: May 18, 2015

(86) PCT No.: PCT/JP2015/064164
§ 371 (c)(1),
(2) Date: Dec. 8, 2016

(87) PCT Pub. No.: WO2015/190228
PCT Pub. Date: Dec. 17, 2015

(65) Prior Publication Data

US 2017/0117610 A1 Apr. 27, 2017

(30) Foreign Application Priority Data

Jun. 13, 2014 (JP) ..... 2014-122254

(51) Int. Cl.
*H01Q 1/22* (2006.01)
*H01Q 1/36* (2006.01)
*H01Q 1/38* (2006.01)

(52) U.S. Cl.
CPC ..... *H01Q 1/2283* (2013.01); *H01Q 1/36* (2013.01); *H01Q 1/38* (2013.01)

(58) Field of Classification Search
CPC ..... H01Q 1/2283; H01Q 1/40
See application file for complete search history.

(56) References Cited

U.S. PATENT DOCUMENTS

2002/0075186 A1 6/2002 Hamada et al.
2008/0079637 A1 4/2008 Okamura et al.
(Continued)

FOREIGN PATENT DOCUMENTS

EP 1 217 688 6/2002
EP 2083473 A1 * 7/2009 ..... H01Q 1/2283
(Continued)

OTHER PUBLICATIONS

Extended European Search Report dated Oct. 23, 2017 in corresponding European Application No. 15806550.8.
(Continued)

*Primary Examiner* — Jessica Han
*Assistant Examiner* — Amal Patel
(74) *Attorney, Agent, or Firm* — Wenderoth, Lind & Ponack, L.L.P.

(57) ABSTRACT

Provided is a chip antenna (1), including: an antenna pattern (3); and a base body (2), which has a hexahedral shape, the antenna pattern (3) including: an antenna part (31), which is held on an upper surface of the base body (2); and a plurality of terminal parts (32), which are held on a lower surface of the base body (2), each of the plurality of terminal parts (32) being soldered to a circuit board (10), in which the antenna pattern (13) further includes a band-shaped protruding part (34), which extends in a long-side direction of the antenna part (31), and is embedded in the base body (2), and the band-shaped protruding part (34) is provided at least along a range of each of two long sides of the antenna part (31) excluding a range in which the plurality of terminal parts (32) are arranged.

7 Claims, 5 Drawing Sheets

(56) References Cited

U.S. PATENT DOCUMENTS

| | | | | |
|---|---|---|---|---|
| 2010/0271265 | A1 | 10/2010 | Sung et al. | |
| 2010/0271272 | A1 | 10/2010 | Sung et al. | |
| 2013/0207849 | A1 * | 8/2013 | Shibahara | H01Q 1/38 343/700 MS |
| 2015/0070223 | A1 | 3/2015 | Sung et al. | |

FOREIGN PATENT DOCUMENTS

| | | | | |
|---|---|---|---|---|
| JP | 56-116303 | | 9/1981 | |
| JP | 10-156860 | | 6/1998 | |
| JP | 10-247817 | | 9/1998 | |
| JP | 2002-252516 | | 9/2002 | |
| JP | 2008-85828 | | 4/2008 | |
| JP | 2008-236014 | | 10/2008 | |
| JP | 2009-090475 | | 4/2009 | |
| JP | 2010-259042 | | 11/2010 | |
| JP | 2012-74835 | | 4/2012 | |
| JP | WO 2012043144 | A1 * | 4/2012 | H01Q 1/38 |
| WO | 2012/015131 | | 2/2012 | |

OTHER PUBLICATIONS

International Search Report dated Aug. 11, 2015 in International (PCT) Application No. PCT/JP2015/064164.

English translation of International Preliminary Report on Patentability and Written Opinion of the International Searching Authority dated Dec. 15, 2016 in International (PCT) Application No. PCT/JP2015/064164.

* cited by examiner

CHIP ANTENNA

TECHNICAL FIELD

The present invention relates to a chip antenna, which is mounted on a circuit board for an electric device (information communication device) having a function of wireless communication, such as a smart meter (digital wattmeter), a cellular phone (including a smartphone), or a laptop or tablet PC.

BACKGROUND ART

In recent years, the number of electric devices and information communication devices having the function of wireless communication has increased, and the demand for chip antennas is also on the rise accordingly, resulting in a need to increase productivity of chip antennas. Under such circumstances, the applicant of the subject application has proposed, as described in Patent Literature 1 provided below, a chip antenna, including an antenna pattern formed through bending a conductive plate, e.g., a metal plate, into a three-dimensional shape, and a base body having a hexahedral shape (rectangular parallelepiped shape), which is formed through injection molding a resin with the antenna pattern as an insert component, and holds the antenna pattern on a surface thereof. Such chip antenna can be manufactured only through the following two steps: subjecting the conductive plate to bending or other such processing to obtain an antenna pattern having a predetermined shape; and forming the base body through injection molding the resin with the antenna pattern as the insert component. As a result, the productivity of the chip antennas can be increased.

In order for the above-mentioned chip antenna including the antenna pattern and the base body holding the antenna pattern to exhibit desired antenna performance with stability, it is necessary to especially hold an antenna part configured to transmit/receive radio waves of the antenna pattern in a state of being held in contact with the base body without a gap therebetween. Accordingly, in the chip antenna of Patent Literature 1, forming, at an edge of the antenna pattern, a tongue-like protruding part to be embedded in the base body, increasing a surface roughness of the antenna pattern at least at a joining surface with the base body, and other such measures are taken.

A chip antenna is generally mounted on a circuit board through so-called reflow processing. The reflow processing is processing in which the chip antenna is placed on solder paste (solder cream) applied on a front surface of the circuit board, and thereafter, all of the chip antenna, the solder paste, and the circuit board are heated at a predetermined temperature (temperature of at least a melting point of the solder or more) for a predetermined period and then cooled in a normal temperature atmosphere, to thereby solder the chip antenna to the circuit board. The reflow processing has an advantage in that chip antennas can be automatically mounted on a plurality of circuit boards at the same time.

CITATION LIST

Patent Literature 1: JP 2012-74835 A

SUMMARY OF INVENTION

Technical Problem

Incidentally, an antenna size of the antenna pattern (size of the antenna part) is determined mainly in consideration of a frequency (wavelength) of the radio waves to be transmitted/received and a gain, and in application of transmitting/receiving radio waves in a low-frequency band, for example, there arises a need to increase a length (size) of the antenna part as compared to application of transmitting/receiving radio waves in a high-frequency band. When the antenna part is increased in length, the base body, which is configured to hold the antenna part, inevitably needs to be increased in length. However, as the base body becomes longer, a deformation amount accompanying mold shrinkage, and further, an amount of heat shrinkage in a longitudinal direction of the base body accompanying the reflow processing becomes larger. Meanwhile, with the antenna pattern being formed of a conductive plate, e.g., a metal having a coefficient of linear expansion significantly smaller than that of a resin, a size of the antenna part does not change accompanying the injection molding of the base body or the reflow processing. Therefore, especially in a chip antenna that is inevitably increased in size to secure required antenna characteristics, as in the chip antenna configured to transmit/receive the radio waves in the low-frequency band, especially accompanying the reflow processing, the base body shrinks significantly in the longitudinal direction as compared to the antenna pattern. In this case, it has been found that taking such measures as described in Patent Literature 1 is insufficient to prevent separation of the antenna part from the base body.

In view of the situation described above, it is an object of the present invention to provide a chip antenna, which increases holding force of the antenna pattern (especially the antenna part) to the base body, and hence is capable of effectively preventing, even when a terminal part of the chip antenna is soldered to the circuit board through the reflow processing, separation of the antenna part of the antenna pattern from the base body.

Solution to Problem

According to one embodiment of the present invention, which is devised to achieve the above-mentioned object, there is provided a chip antenna, comprising: an antenna pattern formed through bending a conductive plate into a three-dimensional shape; and a base body, which is formed through injection molding a resin with the antenna pattern being inserted, and has a hexahedral shape holding the antenna pattern on a surface thereof, the antenna pattern comprising: an antenna part, which is held on an upper surface of the base body, and has a substantially rectangular shape; and a plurality of terminal parts, which are held on a lower surface of the base body, and are arranged along long sides of the antenna part, each of the plurality of terminal parts being soldered to a circuit board, wherein the antenna pattern further comprises a band-shaped protruding part, which extends in a long-side direction of the antenna part, and is embedded in the base body, and the band-shaped protruding part is provided at least along a range of each of two long sides of the antenna part excluding a range in which the plurality of terminal parts are arranged. The "antenna part" as used herein is a part configured to perform at least one of transmission or reception of radio waves. Moreover, the "upper surface of the base body" means a surface that is at a location separated from the circuit board and is parallel to the circuit board, and the "lower surface of the base body" means a surface (contact surface) opposed to the circuit board.

Heat shrinkage that occurs in the base body accompanying reflow processing generally occurs mainly in a direction of decreasing a length of the base body, that is, in a long-side direction of the antenna part. Therefore, with the protruding part, which is embedded in the base body, being provided at least along each of the two long sides of the antenna part (more specifically, in the range of the long sides excluding the range in which the terminal parts are arranged) as in the present invention, even when the terminal parts of the chip antenna are soldered to the circuit board through the reflow processing, the heat shrinkage that occurs in the base body accompanying the reflow processing may be suppressed. Moreover, when the protruding part, which is embedded in the base body, has a band shape, a contact area between the protruding part (antenna pattern) and the base body may be increased as compared to the related-art structure in principle, and hence holding force of the antenna pattern to the base body is increased. Further, with the band-shaped protruding part being formed along each of the two long sides of the antenna part, flexural rigidity in the long-side direction of the antenna part is increased. With the above-mentioned synergistic effect, the holding force of the antenna part of the antenna pattern to the base body may be increased, and a probability of the antenna part being partly separated from the base body (the antenna part being partly elevated from the base body) may be effectively reduced.

The band-shaped protruding part may further be provided between the two long sides of the antenna part (in a range in a width direction of the antenna part). With this structure, the above-mentioned actions and effects, which are achieved when the present invention is adopted, may be enjoyed more effectively.

It is preferred that the band-shaped protruding part be formed so that the band-shaped protruding part forms an obtuse angle with respect to the antenna part. With this structure, force in a direction of preventing the antenna part from being separated from a front surface of the base body (force in a direction of pressing the antenna part against the front surface of the base body) may be caused to act on the band-shaped protruding part. As a consequence, the possibility of the antenna part being separated from the base body may be reduced more effectively.

The base body may have a through hole, which is formed at a location immediately below the antenna part to extend in a thickness direction of the antenna part, and has an inner wall surface, which is a molded surface formed using a mold of the base body. This means that the base body is formed through injection molding in a state in which the antenna part of the antenna pattern is pressed against an inner wall surface of the mold by a pin-like pressing member (pressing pin) formed in the mold. As a consequence, molding accuracy of the base body, and further, position accuracy of the antenna part with respect to the base body is increased, with the result that a probability of occurrence of defective products may be effectively reduced, and a chip antenna capable of exhibiting desired antenna characteristics may be produced in volume with stability.

In order to further enhance contact between the antenna pattern and the base body, it is preferred that the antenna pattern (conductive plate) have a surface roughness Ra of 1.6 or more at least at a joining surface with the base body.

It is preferred that the resin molded for forming the base body have a high permittivity from the viewpoint of securing the desired antenna characteristics, and specifically, it is preferred that the resin have a permittivity of 4 or more. The resin having a permittivity of 4 or more is not necessarily limited to a resin in which a base resin has a permittivity of 4 or more, and comprises a resin in which the entire resin formulated with a filler has a permittivity of 4 or more.

The present invention may be applied favorably to a chip antenna in which a base body is molded into a hexahedral shape having an opening at least in the above-mentioned lower surface (surface opposite to the surface on which the antenna part is held), or to a chip antenna in which a base body is molded into a solid hexahedral shape, for example. The former case is advantageous over the latter case in that an amount of usage of the resin, and an amount of deformation of the base body accompanying the mold shrinkage or the like may be suppressed, and in other such points.

Advantageous Effects of Invention

As described above, according to the present invention, it is possible to effectively increase holding force of the antenna pattern to the base body. As a result, it is possible to effectively prevent, in particular, even when the terminal part of the chip antenna is soldered to the circuit board through the reflow processing, separation of the antenna part of the antenna pattern from the base body, and hence to realize the chip antenna, which is capable of exhibiting the desired antenna performance with stability.

DESCRIPTION OF EMBODIMENTS

Now, description is made of embodiments of the present invention with reference to the drawings.

Figure 1:
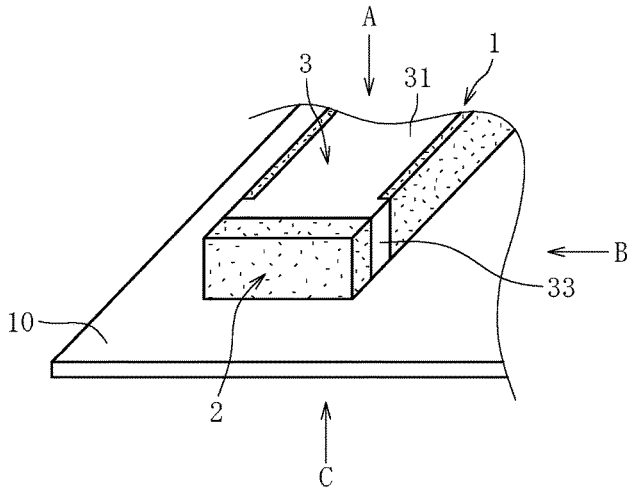
FIG. 1 is a schematic perspective view of a circuit board having a chip antenna according to an embodiment of the present invention mounted on a surface thereof.
Figure 2:
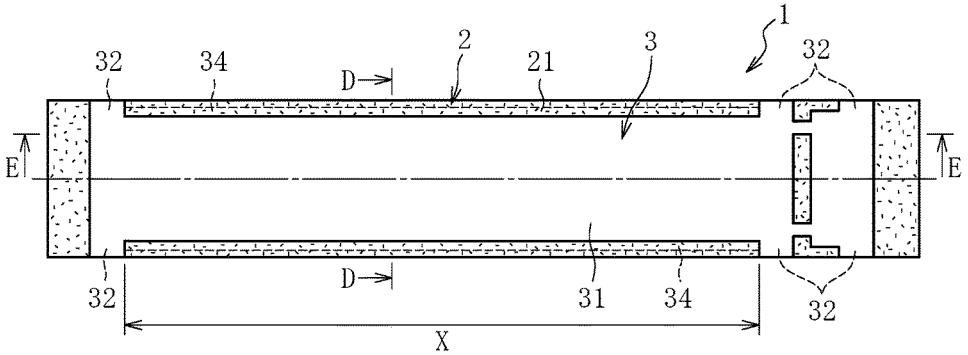
FIG. 2 is a plan view (top view) of the chip antenna illustrated in FIG. 1 when viewed from the direction A illustrated in FIG. 1.
Figure 3:
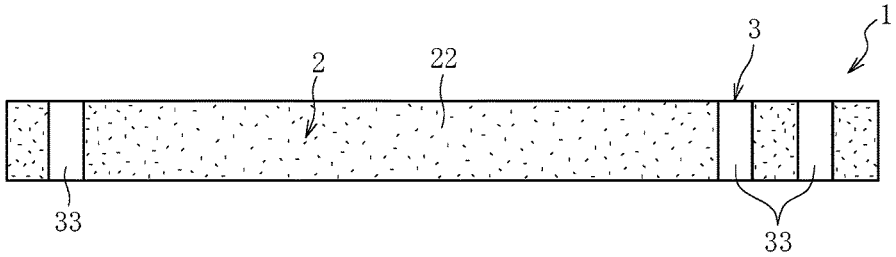
FIG. 3 is a plan view (left side view) of the chip antenna illustrated in FIG. 1 when viewed from the direction B illustrated in FIG. 1.
Figure 4:
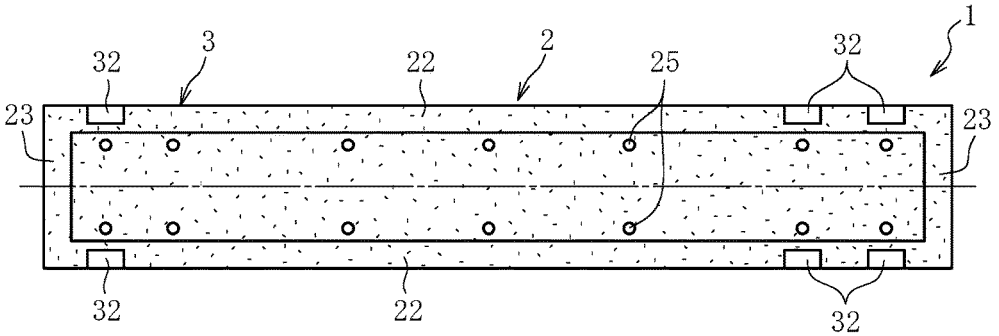
FIG. 4 is a plan view (bottom view) of the chip antenna illustrated in FIG. 1 when viewed from the direction C illustrated in FIG. 1.

FIG. 1 is a partial schematic perspective view of a circuit board 10 having a chip antenna 1 according to an embodiment of the present invention mounted on a surface thereof. The chip antenna 1 illustrated in FIG. 1 comprises an antenna pattern 3 formed of a conductive plate and a base body 2 formed through injection molding a resin with the antenna pattern 3 as an insert component. An entire length dimension of the chip antenna 1 (in FIG. 2, for example, dimension in a right and left direction of the drawing sheet) is set depending on the frequency (wavelength) of radio waves to be transmitted/received by the chip antenna 1. For example, when the chip antenna 1 is used for application of transmitting/receiving radio waves in a 920-MHz band (an example includes a smart meter), an entire length dimension of an antenna part 31 of the antenna pattern 3 is set to about 40 mm, for example. An entire length dimension of the base body 2 configured to hold the antenna pattern 3 is set at least larger than the entire length dimension of the antenna part 31, and when the entire length dimension of the antenna part 31 is set to about 40 mm as described above, the entire length dimension of the base body 2 is set to about 50 mm, for example. The entire length dimension of the base body 2 is changed as appropriate depending on a size of a space for mounting the antenna on the circuit board 10, and the like.

The base body 2 in this embodiment has a hexahedral shape having an opening in a center region of a lower surface. To describe more specifically, as illustrated in FIG. 2 to FIG. 5, the base body 2 in this embodiment has a rectangular plate-like top wall 21, which is substantially parallel to the circuit board 10, a pair of side walls 22 and 22 provided upright along two long sides of the top wall 21, and a pair of end walls 23 and 23 provided upright along two short sides of the top wall 21. In other words, the base body 2 according to this embodiment has a recessed shape having the opening in the lower surface in section at respective parts in a longitudinal direction thereof except for the both end parts in the longitudinal direction, in which the pair of end walls 23 and 23 are provided. Thicknesses of the top wall 21, side walls 22, and end walls 23 are set to be approximately the same in a range of, for example, from 0.5 mm to 2.5 mm.

Figure 6:
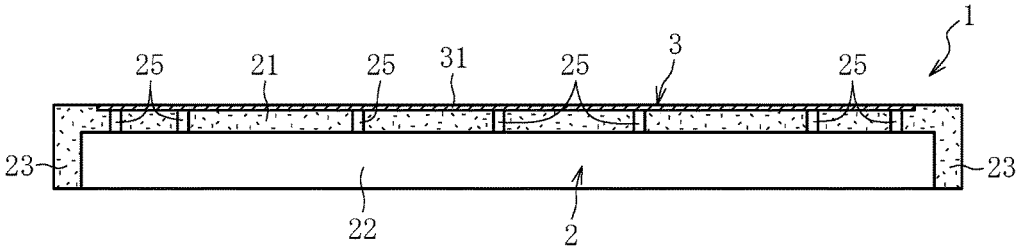
FIG. 6 is a sectional view of the chip antenna, and is an arrow sectional view taken along the line E-E of FIG. 2.

In the top wall 21 forming the base body 2, as illustrated in FIG. 6, a plurality of through holes 25 are formed to extend in a thickness direction of the antenna part 31 of the antenna pattern 3. Each through hole 25 has openings on both of front and rear surfaces of the top wall 21 at a location immediately below the antenna part 31, and has an inner wall surface, which is a molded surface formed by a mold 50 (see FIG. 8) of the base body 2.

As described above, the base body 2 is formed through injection molding a resin with the antenna pattern 3 as an insert component. As the resin for forming the base body 2, a resin having a permittivity of 4 or more is selected and used. For example, one kind or two or more kinds of thermoplastic resins selected from the group consisting of polyphenylene sulfide (PPS), liquid crystal polymers (LCPs), polyamides (PAs), and the like as a base resin formulated with a filler, e.g., ceramic can be used.

The antenna pattern 3 is formed into a three-dimensional shape through bending a conductive plate into the three-dimensional shape, and, as illustrated in FIG. 2 to FIG. 6, comprises, in an integral manner, the substantially rectangular antenna part 31 having a pair of long sides and a pair of short sides, a plurality of (in this embodiment, a total of six) terminal parts 32 arranged along the long sides of the antenna part 31, and connecting parts 33 configured to connect the antenna part 31 and the respective terminal parts 32. The antenna part 31 is held on a top surface (front surface of the top wall 21) of the base body 2 in a state in which a front surface of the antenna part 31 is exposed to the outside, and each terminal part 32 is held on a lower surface (lower end surface of the side wall 22) of the base body 2 in a state in which a front surface of the terminal part 32 is exposed to the outside. Moreover, each connecting part 33 is held on a side surface (front surface of the side wall 22) of the base body 2 in a state in which a front surface of the connecting part 33 is exposed to the outside. In reality, the connecting parts 33 also transmit/receive radio waves, but the amount of radio waves transmitted/received by the connecting parts 33 is negligibly small compared to the amount of radio waves transmitted/received by the antenna part 31.

Although detailed illustration is omitted, the chip antenna 1 is mounted (fixed) to the circuit board 10 illustrated in FIG. 1 through soldering the total of six terminal parts 32, which are formed in the antenna pattern 3, to the circuit board 10. This soldering is often performed through so-called reflow processing. At least one of the total of six terminal parts 32 functions as a feeding terminal electrically connected to a feeder of the circuit board 10, and at least one of the remaining terminal parts 32 functions as a ground terminal configured to ground the antenna pattern 3 via the circuit board 10. Further, the terminal parts 32 other than those that function as the feeding terminal and as the ground terminal function as fixing parts configured to fix the chip antenna 1 to the circuit board 10.

As the conductive plate serving as a base material of the antenna pattern 3, there is used, for example, a metal plate, such as a copper plate, a steel plate, or a SUS plate, or a plated metal plate thereof, which has a thickness set so as to be as small as possible insofar as the desired three-dimensional shape may be maintained (for example, 1 mm or less, and more preferably 0.5 mm or less). In order to enhance the contact between the antenna pattern 3 and the base body 2, the antenna pattern 3 has a surface roughness Ra set to be 1.6 or more, and preferably 3.2 or more at least at a joining surface (rear surface) with the base body 2.

Figure 5:
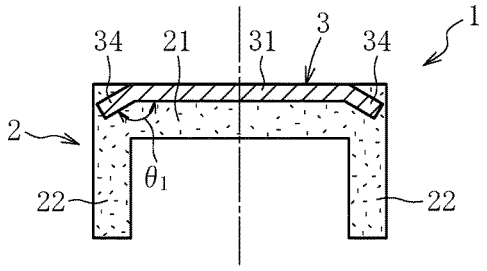
FIG. 5 is a sectional view of the chip antenna, and is an arrow sectional view taken along the line D-D of FIG. 2.

The antenna pattern 3, which is formed through bending the conductive plate into the three-dimensional shape, further comprises, in an integral manner, band-shaped protruding parts 34, which extend in a long-side direction of the antenna part 31, and are embedded in the base body 2 (see FIG. 5). Those band-shaped protruding parts 34 are provided, as indicated by the broken lines in FIG. 2, at least along a range (in this embodiment, a range indicated by the reference symbol X in FIG. 2) of the two long sides of the antenna part 31 excluding a range in which the terminal parts 32 are arranged (range in which the connecting parts 33 are provided). Moreover, as illustrated in FIG. 5, the band-shaped protruding parts 34 are formed so that the band-shaped protruding parts 34 form an obtuse angle $\theta_1$ ($90° < \theta_1 < 180°$ with respect to the antenna part 31.

Next, a method of manufacturing the chip antenna 1 having the structure described above is described with reference to FIG. 7 and FIG. 8. To describe briefly, the chip antenna 1 according to this embodiment is manufactured by being sequentially fed to a first step S1 of forming a developed pattern 3' in a long conductive plate (hoop material 40), a second step S2 of bending the developed pattern 3' to form the antenna pattern 3, a third step S3 of forming the base body 2 through injection molding a resin with the antenna pattern 3 as an insert component, and a fourth step S4 of removing the chip antenna 1 from the hoop material 40.

In the first step S1, through punching part of the hoop material 40 with a press mold (not shown), the developed pattern 3' that is the antenna pattern 3 in the three-dimensional shape developed on a plane is formed. The developed pattern 3' is coupled to a frame 41 of the hoop material 40 via bridges 42. A reference symbol 43 in FIG. 7 denotes alignment holes in the hoop material 40 with respect to a conveying apparatus (not shown).

Figure 7:
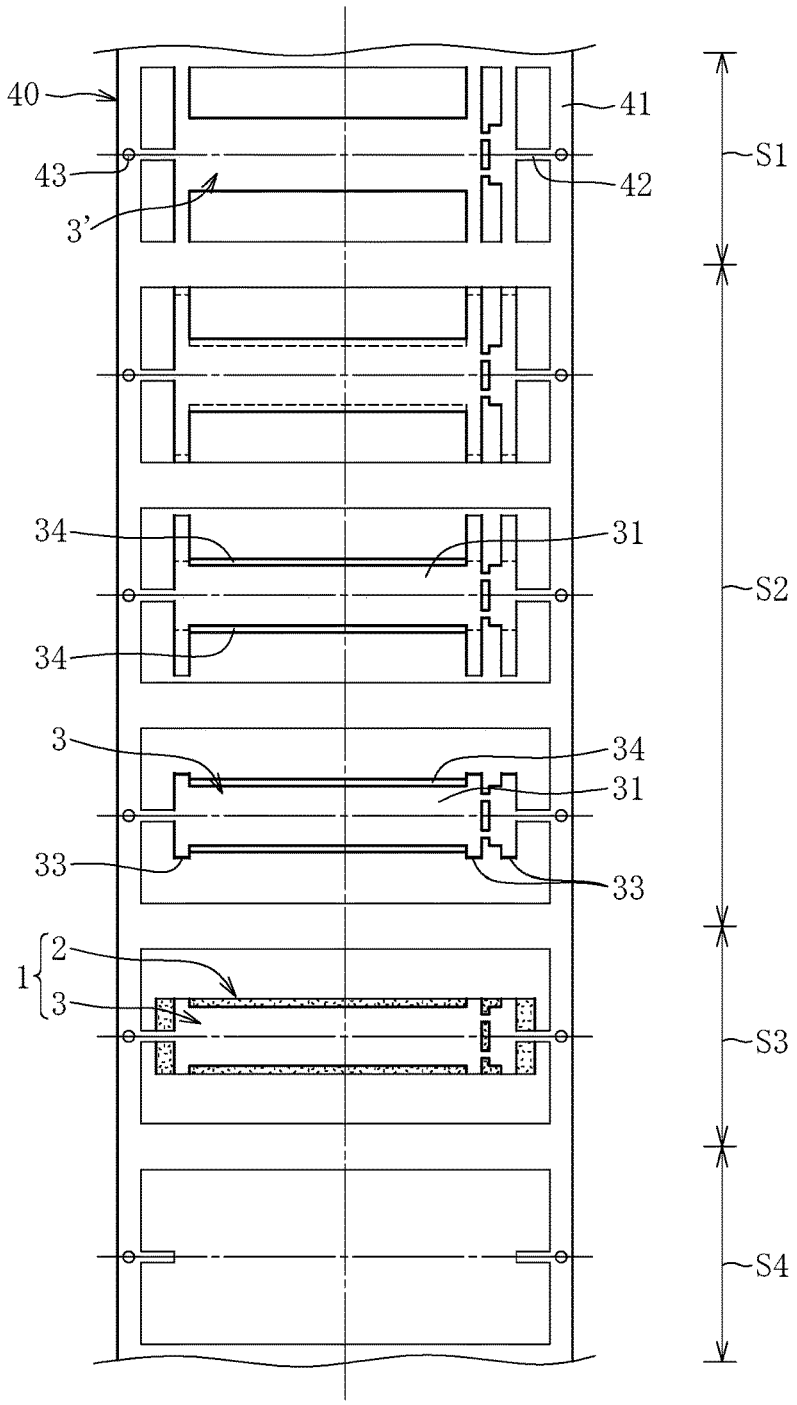
FIG. 7 is an explanatory view of processes for manufacturing the chip antenna illustrated in FIG. 1 to FIG. 6.

When a developed pattern 3' is formed in the hoop material 40, the hoop material 40 is conveyed downward in FIG. 7, and a part of the hoop material 40 in which the developed pattern 3' is formed is fed to the second step S2. In the second step S2 in the illustrated example, processing of forming bend lines (indicated by the broken lines in FIG. 7) for appropriately and easily bending the developed pattern 3', and bending processing of bending the developed pattern 3' with the bend lines being fulcra are performed to form, in the hoop material 40, the antenna pattern 3 having the three-dimensional shape, which comprises the antenna part 31, the terminal parts 32, the connecting parts 33, and the band-shaped parts 34 in the integral manner. The antenna pattern 3 formed in the hoop material 40 is coupled to the frame 41 via the bridges 42. Although detailed illustration is omitted, the processing of forming the bend lines is executed using a press mold, for example, and the bending processing is executed using a press mold, or an actuator, such as an air cylinder or a hydraulic cylinder.

Figure 8A:
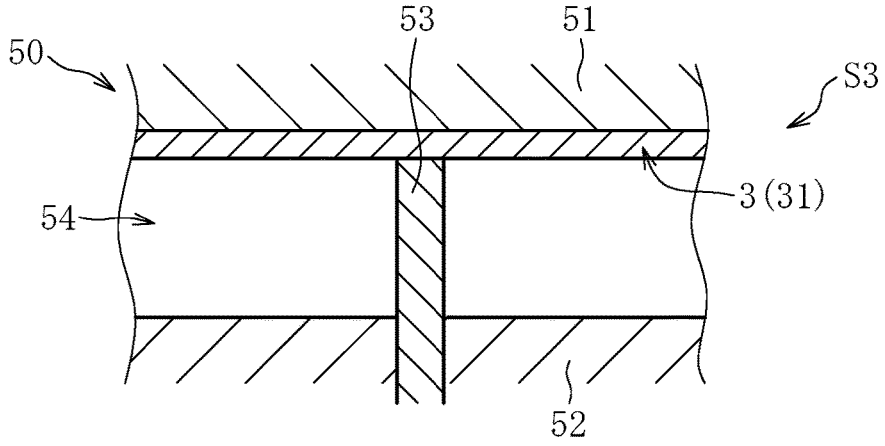
FIG. 8A is a sectional view of a main part of a mold for injection molding a base body of the chip antenna, for schematically illustrating a state in which the mold is swaged.
Figure 8B:
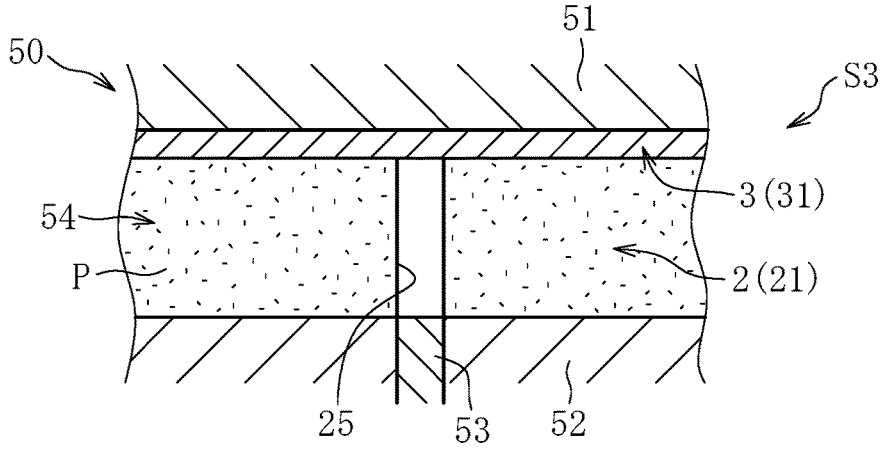
FIG. 8B is a sectional view of the main part of the mold for injection molding the base body of the chip antenna, for schematically illustrating a state in which a resin is injected into the mold.

Then, the hoop material 40 is conveyed further downstream, and the part in which the antenna pattern 3 is formed is fed to the third step S3. In the third step S3, first, as illustrated in FIG. 8A, an upper mold 51 and a lower mold 52 of the mold 50 are moved so as to be relatively closer to each other so that the mold 50 is swaged, and the antenna pattern 3 is arranged, as an insert component, in a cavity 54 defined between the upper mold 51 and the lower mold 52. A plurality of pressing pins 53 that are vertically movable with respect to the lower mold 52 are arranged in a part of the mold 50 for forming the top wall 21 of the base body 2. When the antenna pattern 3 is arranged in the cavity 54 as the insert component, the pressing pins 53 move upward so that an upper surface (front surface) of the antenna part 31 of the antenna pattern 3 may be pressed against a lower surface of the upper mold 51 (the antenna part 31 may be sandwiched between and fixed by the upper mold 51 and the pressing pins 53). In this state, a resin P (at least one kind selected from the group consisting of PPS, an LCP, a PA, and the like as a base resin formulated with a filler, e.g., ceramic) in a molten state is injected and filled into the cavity 54 (see FIG. 8B). After the resin P is solidified, the mold 50 is opened to obtain the chip antenna 1 comprising the antenna pattern 3 and the base body 2 and being coupled to the frame 41 of the hoop material 40 via the bridges 42.

The pressing pins 53 may be formed integrally with the lower mold 52. In this case, as the mold 50 is swaged, the antenna part 31 of the antenna pattern 3 is pressed against the lower surface of the upper mold 51.

The base body 2 is formed through injection molding the resin integrally with the antenna pattern 3 coupled to the frame 41 of the hoop material 40 to obtain the chip antenna 1 comprising the base body 2 and the antenna pattern 3. Then, the chip antenna 1 coupled to the frame 41 of the hoop material 40 is fed to the fourth step S4. In the fourth step S4, the molded product (chip antenna 1) is separated from the frame 41 of the hoop material 40.

The fourth step S4 for separating the chip antenna 1 from the hoop material 40 is not necessarily required to be sequentially provided downstream of the third step S3. Specifically, instead of the fourth step S4 for separating the chip antenna 1 from the hoop material 40, a winding step may be provided downstream of the third step S3. The winding step comprises winding, in a roll, the hoop material 40 in which (the antenna pattern 3 of) the chip antenna 1 is left coupled to the frame 41 via the bridges 42. Winding the hoop material 40 without separating the chip antenna 1 from the frame 41 in this way makes storage and conveyance of the hoop material 40 easier. Further, the aligned state of the chip antenna 1 can be maintained, and thus, contact (interference) among the chip antennas 1 can be prevented as much as possible.

As described above, in the chip antenna 1 according to the present invention, the band-shaped protruding parts 34, which extend along the two long sides of the antenna part 31, and are embedded in the base body 2, are provided in the antenna pattern 3 in the integral manner. With this structure, even when the terminal parts 32 of the chip antenna 1 are soldered to the circuit board 10 through the reflow processing, heat shrinkage that occurs especially in a part, in which the antenna part 31 is held, of the base body 2 accompanying the reflow processing may be suppressed. Moreover, when the protruding parts 34 embedded in the base body 2 have the band shapes, the contact area between the protruding parts 34 (antenna pattern 3) and the base body 2 may be increased significantly as compared to the related-art structure in principle, and hence holding force of the antenna pattern 3 to the base body 2 is increased.

Moreover, with the band-shaped protruding parts 34 being formed along the two long sides of the antenna part 31, flexural rigidity of the antenna part 31 in the long-side direction is increased. Further, with the angle θ1 formed by the band-shaped protruding parts 34, which are embedded in the base body 2, with respect to the antenna part 31 being set to the obtuse angle, force in a direction of preventing separation of the antenna part 31 from the front surface of the base body 2 (direction of pressing the antenna part 31 against the front surface of the base body 2) acts on the protruding parts 34.

With the above-mentioned synergic effect, the holding force of especially the antenna part 31 of the antenna pattern 3 to the base body 2 is increased, and a probability of the antenna part 31 being partly separated from the base body 2 (the antenna part 31 entering a state of being partly elevated) may be effectively reduced. As a result, the chip antenna 1 capable of exhibiting the desired antenna characteristics with stability may be realized.

Moreover, in the chip antenna 1 according to this embodiment, the base body 2 is formed into the hexahedral shape having the opening in one surface (lower surface). With this structure, as compared to a case where the base body 2 is formed into a solid hexahedral shape (rectangular parallelepiped shape), a deformation amount of the base body 2 accompanying mold shrinkage may be suppressed. This also enables the antenna part 3 of the antenna pattern 1 to be held on the front surface of the base body 2 with stability. Moreover, when the base body 2 is formed into the hexahedral shape having the opening in one surface, as compared to the case where the base body 2 is formed into the solid hexahedral shape, an amount of usage of the resin may be suppressed to reduce a cost of the chip antenna 1.

Further, the base body 2 has the through holes 25, which are formed at the locations immediately below the antenna part 31 of the antenna pattern 3 to extend in the thickness direction of the antenna part 31, and have the inner wall surfaces, which are the molded surfaces formed using the mold 50 of the base body 2. This means that the base body 2 is formed through injection molding in a state in which the antenna part 31 of the antenna pattern 3 is pressed against an inner wall surface of the mold 50 (in this embodiment, upper mold 51) by the pressing pins 53 formed in the mold 50. As a consequence, molding accuracy of the base body 2 (top wall 21), and further, position accuracy of the antenna part 31 with respect to the top wall 21 of the base body 2 is increased, with the result that a probability of occurrence of defective products may be effectively reduced, and the chip antenna 1 capable of exhibiting the desired antenna characteristics may be produced in volume with stability.

There has been described the chip antenna 1 according to one embodiment of the present invention, but changes may be made to the chip antenna 1 as appropriate without departing from the gist of the present invention.

Figure 9A:
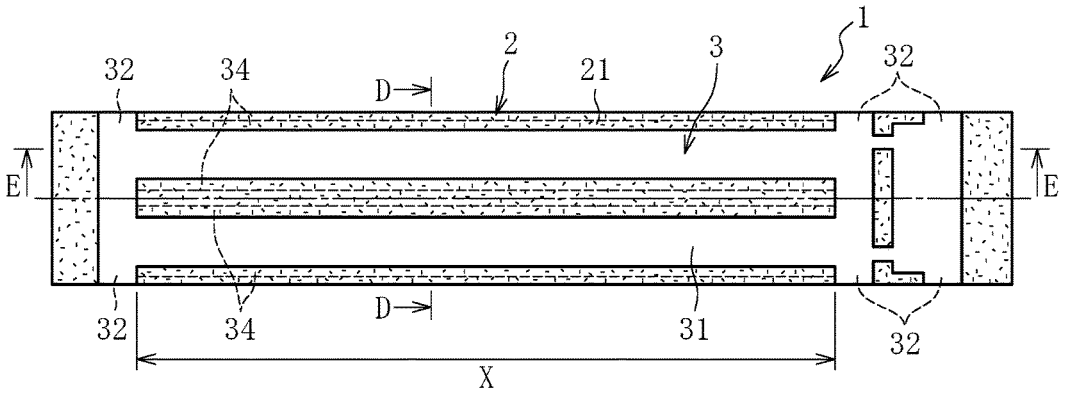
FIG. 9A is a plan view (top view) of a chip antenna according to another embodiment of the present invention.
Figure 9B:
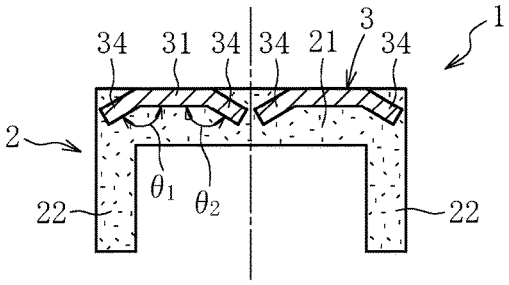
FIG. 9B is an arrow sectional view taken along the line D-D of FIG. 9A.

For example, as long as the antenna characteristics of the chip antenna 1 are not adversely affected in particular, the band-shaped protruding parts 34 embedded in the base body 2 may further be provided between the two long sides of the antenna part 31 (that is, in a range in a width direction of the antenna part 31) as illustrated in FIG. 9A and FIG. 9B. In the illustrated example, a total of four protruding parts 34 are provided. With this structure, the probability of the antenna part 31 being separated from the base body 2 may be reduced more effectively. Although detailed illustration is omitted, the two protruding parts 34 provided between the two long sides of the antenna part 31 may be formed through forming a slit parallel to the long sides of the antenna part 31 in a center part in the width direction of the antenna part 31, and then bending parts provided on both sides of the slit, for example. Also when such structure is adopted, for reasons similar to those described above, it is preferred that both of the angle θ1 formed by the band-shaped protruding parts 34 provided along the long sides of the antenna part 31 with respect to the antenna part 31, and an angle θ2 formed by the band-shaped protruding parts 34 provided between the two long sides of the antenna part 31 with respect to the antenna part 31 be set to obtuse angles. The angles θ1 and θ2 may be the same value, or may be different from each other.

Moreover, although illustration is omitted, protruding parts (in this case, tongue-like protruding parts) embedded in the base body 2 may be provided also in the connecting parts 33 as long as the protruding parts may be provided in an integral manner with the antenna pattern 3 by subjecting the conductive plate (hoop material 40) to bending processing. Although illustration is similarly omitted, in the example illustrated in FIG. 2, for example, protruding parts embedded in the base body 2 may also be provided, of the long sides of the antenna part 31, in a range between two terminal parts 32 and 32 arranged side by side in the longitudinal direction of the chip antenna 1 (the terminal part 32 arranged on the far right in FIG. 2, and the terminal part 32 arranged adjacent on the left side thereof).

Moreover, as long as the rigidity required of the chip antenna 1 is secured, the end walls 23 and 23 provided to the base body 2 may be omitted. In this case, the amount of usage of the resin may be further reduced, and hence there is an advantage in that the chip antenna 1 may be further reduced in cost.

Moreover, in the above description, the present invention has been applied to the chip antenna 1 in which the base body 2 is formed into the hexahedral shape having the opening at least in the surface (lower surface) opposite to the surface on which the antenna part 31 of the antenna pattern 3 is held. However, as long as the amount of mold shrinkage of the base body 2 or the amount of heat shrinkage that occurs in the base body 2 accompanying the reflow processing is so small that the antenna part 31 is not separated from the base body 2, the present invention may also be applied with no problem to the chip antenna 1 in which the base body 2 is formed into the solid hexahedral shape (rectangular parallelepiped shape).

Moreover, the shape of the antenna pattern 3 described above is merely an example, and the shape of the antenna part 31 is changed as appropriate depending on the required antenna characteristics. Moreover, the number and arrangement mode of the terminal parts 32 to be provided in the antenna pattern 3 are also changed arbitrarily depending on the form, circuit configuration, and the like of the circuit board 10 on which the chip antenna 1 is to be mounted, and seven or more terminal parts 32 may be provided, for example. When the total of seven terminal parts 32 are provided in the antenna pattern 3, four terminal parts 32 are arranged along one long side of the antenna part 31, and the remaining three terminal parts 32 are arranged along the other long side of the antenna part 31, for example. In this case, the band-shaped protruding parts 34 respectively provided on the two long sides of the antenna part 31 are different from each other in dimension in the longitudinal direction.

REFERENCE SIGNS LIST 1 chip antenna
2 base body
3 antenna pattern
10 circuit board
21 top wall
22 side wall
23 end wall
25 through hole
31 antenna part
32 terminal part
33 connecting part
34 band-shaped protruding part
40 hoop material (conductive plate)
50 mold
53 pressing pin
S1 first step
S2 second step
S3 third step
S4 fourth step

The invention claimed is:

1. A chip antenna, comprising:

an antenna pattern formed through bending a conductive plate into a three-dimensional shape; and a base body, which is formed through injection molding a resin with the antenna pattern being inserted, and has a hexahedral shape holding the antenna pattern on a surface thereof, the antenna pattern comprising:

an antenna part, which is located on an upper surface of the base body, and has a substantially rectangular shape in which two long sides are arranged along a longitudinal direction of the base body;

a plurality of terminal parts, which are located on a lower surface of the base body, and are arranged along the two long sides of the antenna part, each of the plurality of terminal parts being soldered to a circuit board; and a band-shaped protruding part, which extends in a long-side direction of the antenna part, and is embedded in the base body, the band-shaped protruding part being provided at least along a range of each of the two long sides of the antenna part excluding a range in which the plurality of terminal parts are arranged, wherein the base body has a through hole, which is formed at a location immediately below the antenna part, extends in a thickness direction of the antenna part, and is opened to the upper surface of the base body and a surface of the base body opposite to the upper surface of the base body, the through hole having an inner wall surface, which is a molded surface formed using a mold of the base body.

2. The chip antenna according to claim 1, wherein the band-shaped protruding part is further provided between the two long sides of the antenna part.

3. The chip antenna according to claim 1, wherein the band-shaped protruding part forms an angle that is set to an obtuse angle with respect to the antenna part.

4. The chip antenna according to claim 1, wherein a part of the antenna pattern at least at a contact surface with the base body has a surface roughness Ra of 1.6 or more.

5. The chip antenna according to claim 1, wherein the base body is formed through injection molding a resin having a permittivity of 4 or more.

6. The chip antenna according to claim 1, wherein the base body has an opening at least in the lower surface, and the opening is defined by a pair of side walls provided upright along two long sides of a rectangular plate-shaped top wall which is substantially parallel to the circuit board, and a pair of end walls provided upright along two short sides of the top wall.

7. The chip antenna according to claim 1, wherein the base body has a solid hexahedral shape.

* * * * *